United States Patent [19]

Greene

[11] 4,305,437

[45] Dec. 15, 1981

[54] IN-CASE CONTAINER FILLING MACHINE

[76] Inventor: James A. Greene, 10655 Blackwalnut, Dallas, Tex. 75243

[21] Appl. No.: 164,325

[22] Filed: Jun. 30, 1980

[51] Int. Cl.[3] ..... B65B 3/04

[52] U.S. Cl. ..... 141/59; 141/231; 141/237; 141/275

[58] Field of Search ..... 141/37, 39–70, 141/285–310, 231–248, 250–284, 98, 85, 86, 87, 88, 115–127, 1–12

[56] References Cited

U.S. PATENT DOCUMENTS 4,055,202 10/1977 Greene ..... 141/59

*Primary Examiner*—Houston S. Bell, Jr.

*Attorney, Agent, or Firm*—Warren H. Kintzinger

[57] ABSTRACT

A container filling device that raises a case of empty containers to be filled to engagement with a centering block and fill tube assembly. Each centering block surrounds a fill tube extending into the container and forms a seal around the neck of the container to be filled while providing communication between the interior of the container and a vacuum system. Fluid operated reciprocating piston pumps, through a system of check valves, draw measured amounts of liquid product from a bulk storage container and thereafter inject the measured amounts through the fill tubes into the containers while air is simultaneously exhausted from the containers by vacuum.

15 Claims, 6 Drawing Figures

IN-CASE CONTAINER FILLING MACHINE

Figure 1:
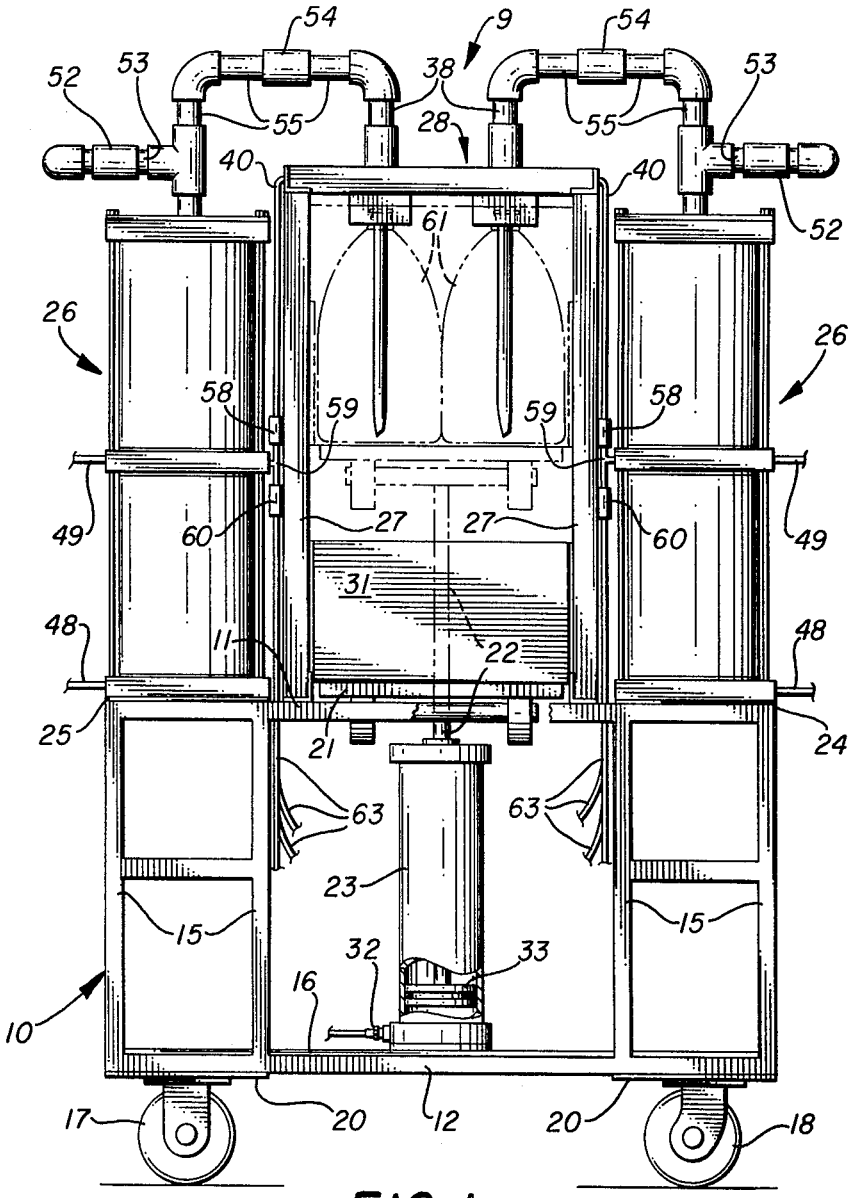

This invention relates in general to container filling apparatus and, in particular, to a device for rapidly transferring premeasured amounts of liquid product into a plurality of case held containers, such as jugs, bottles or the like.

Container filling machines have long been used for simultaneously filling a number of bottles, or other containers, with liquids. Some incorporate predetermined measures of liquid for each container. Others employ the "in-case" filling features, wherein a number of empty containers in a packing box or case are position-oriented to communicate with individual ones of plural filling tubes. Various air venting means are known by which ready escape of air is provided for each bottle as it is filled, particularly where the bottle neck engagingly opens a fill valve between supply source and the container. Individual ones and combinations of these features are found, for example, in U.S. Pat. Nos. 1,419,235 Desobry, 917,155 Sanders, 963,119 Champ, 630,309 Denham and 212,494 Paddock.

Many prior art devices, such as those typified above, were generally concerned with gravity flow of liquid at a flow rate determined by restrictions imposed by fill tube geometry and the viscosity of the liquid being bottled.

In U.S. Pat. No. 4,055,202, "In-Case Bottle Filling Apparatus" by the inventor of the present invention, there is disclosed apparatus using a single common pressure source to fill a plurality of cased bottles simultaneously and a single common vacuum source to exhaust the air from the bottles as they are being filled.

It is, then, a principal object of the present invention to provide an automatic in-case container filling apparatus wherein a preselected measure of liquid for each container is extracted from a bulk supply container by the intake stroke of a pump and injected into the container by the output stroke of the pump.

Another object of the present invention to provide automatic in-case container filling apparatus using vacuum air exhaust from a container being filled by the same pumping means used to pressure fill the container.

Still another object of the present invention to provide automatic in-case container filling apparatus wherein the speed of filling is easily adjustable by adjustment of the fluid pressure of the control system.

Features of this invention useful in accomplishing the above objects include an elevator table to raise shipping case containing a plurality of containers to be filled to engagement with an assembly having a fill tube and centering block structure for each container. The centering blocks each surround a fill tube and act to seal the containers and provide communication with a vacuum exhaust line. A double acting piston on a common shaft with a double acting pump means controls the pump to intake a metered amount of liquid from a bulk supply source and output that metered amount of liquid to fill the container. At the same time the other end of the double acting pump exhausts air from the container as it is filled.

A specific embodiment representing what is presently regarded as the best mode of carrying out the invention is illustrated in the accompanying drawings.

Figure 2:
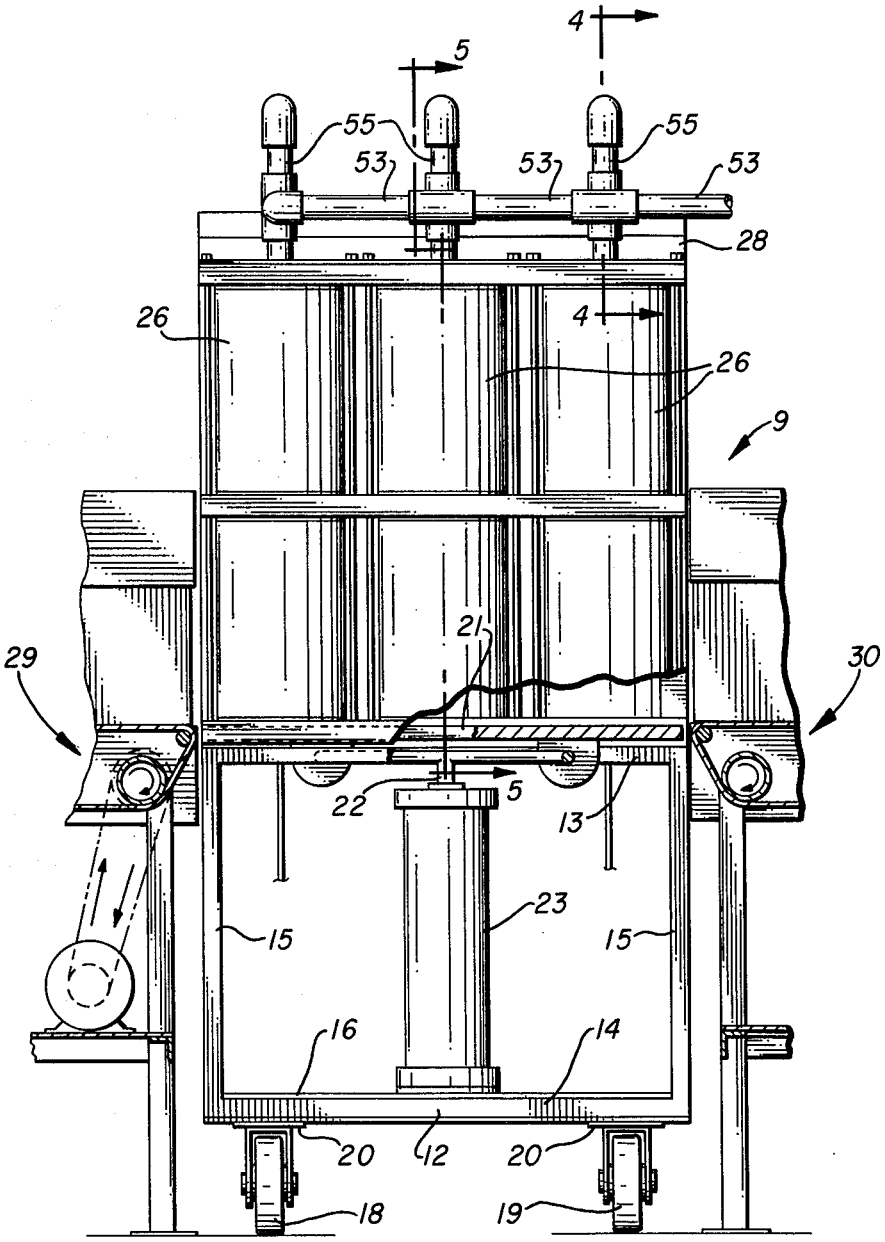
Figure 3:
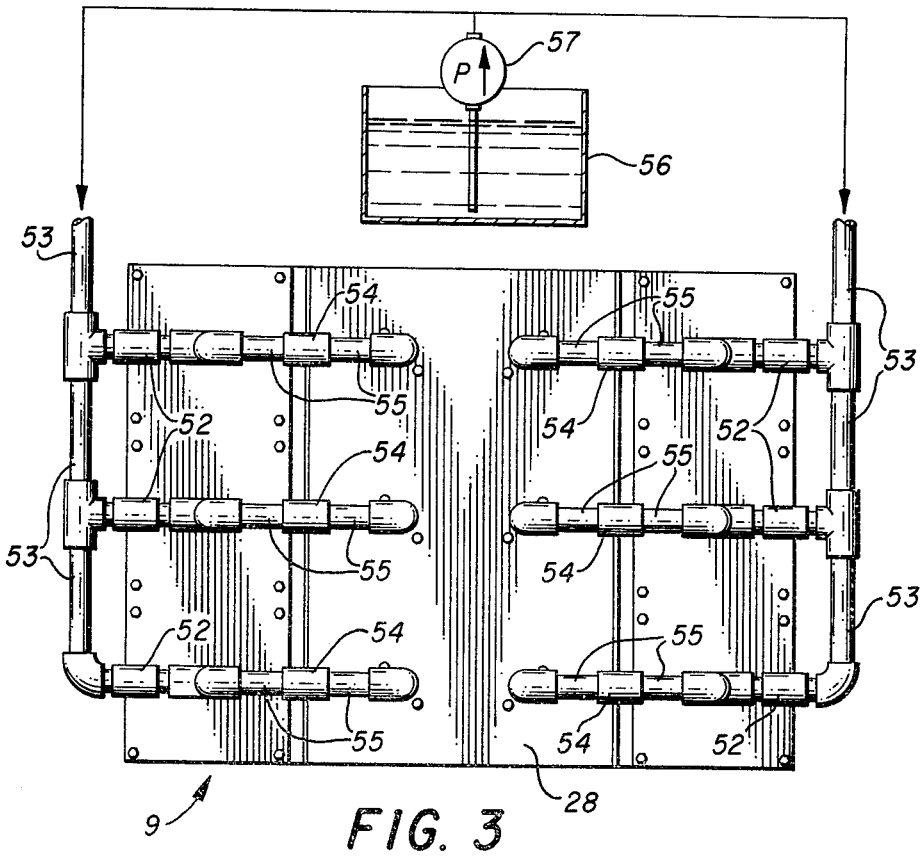
Figure 4:
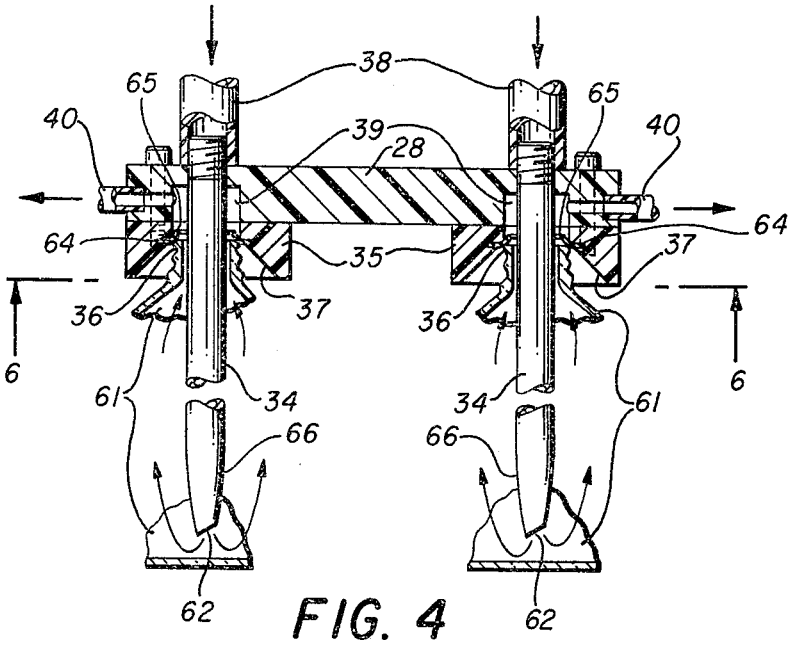
Figure 5:
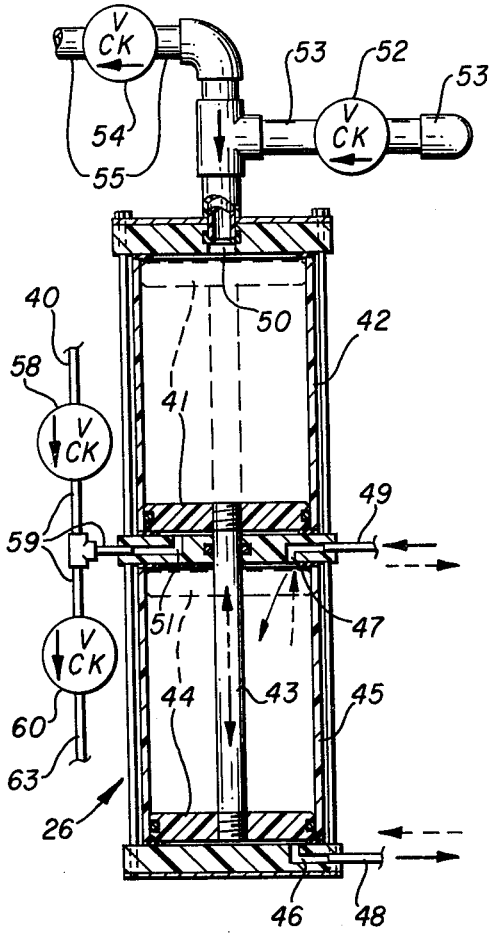
Figure 6:
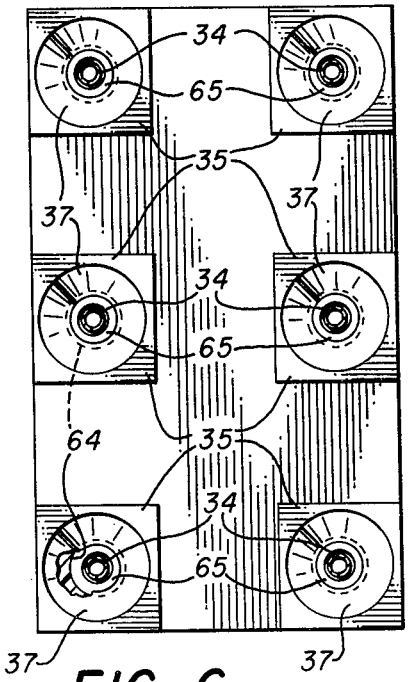

In the drawings:

FIG. 1 is a side elevation view of the apparatus of the present invention mounted on a wheeled carrier for easy movement about a work site;

FIG. 2, a front elevation view of the apparatus of the present invention mounted on a wheeled carrier and positioned for use with a conveyor system;

FIG. 3, a top view of the apparatus of the present invention;

FIG. 4, a view partially in section of the apparatus of the present invention taken along lines 4—4 of FIG. 2;

FIG. 5, a view taken along lines 5—5 of FIG. 2 showing, in section, double acting pump and control device which may be used with the present invention; and FIG. 6, a bottom view along lines 6—6 of FIG. 4 showing details of the centering blocks and seals but omitting the containers shown in FIG. 4.

Referring to the drawings:

Reference is now made to the drawings, and particularly to FIGS. 1 and 2, which show the automatic container filling apparatus 9 of the present invention in side and front views respectively. The apparatus comprises a frame 10 having upper and lower longitudinal members 11 and 12, upper and lower cross members 13 and 14, and upright members 15. A base plate 16 is affixed to the lower cross and longitudinal members. The frame 10 is mounted on four wheels, three of which, 17, 18 and 19, are visible in the drawings, through mounting plates 20, providing mobility of the apparatus. An elevator shelf 21 is mounted on the piston shaft 22 of a fluid cylinder 23. Mounted on front and rear top plates 24 and 25, respectively, are double acting piston controlled pump assemblies 26.

The number and size of the pump assemblies 26 is dependent on the number and size of the containers to be filled. For purposes of illustration it will be assumed that the illustrated unit is designed to fill simultaneously six one-gallon containers nested in a single packing case. Additional upright members 27 act as guides for elevator shelf 21 and as mounting supports for a centering block and fill tube assembly designated generally as 28.

In operation the container filling apparatus is positioned between two conveyors 29 and 30, as shown in FIG. 2. A shipping carton 31, containing six one-gallon containers 61 to be filled, is received from conveyor 29 and automatically positioned on elevator shelf 21 (see FIG. 1). Pressurized fluid from a source (not shown) is then admitted to the inlet port 32 of cylinder 23 causing piston 33 and attached shaft 22 to rise, thus elevating shelf 21 and the case 31 with its containers until the necks of the containers engage centering and seal blocks of assembly 28.

As best shown in FIGS. 4 and 6, the fill tube and centering block assembly 28 comprises a fill tube 34 and a surrounding centering block 35 positioned over each container to be filled. Centering blocks 35 may be of nylon, "Teflon", or other suitable material. Filler tubes 34 may be of any suitable material such as plastic. Advantageously the filler tubes terminate in a tapered section 66, the bottom end of which is angle cut as at 62 to provide a smaller diameter element requiring less critical centering of the container neck for entry of the filler tube. Thus as the elevator shelf 21 lifts the containers 61, the fill tubes 34 are inserted through the necks of the containers. The elevator shelf 21 continues to lift the containers until the rim 36 of each container engages the conical walls 37 of the opening on the underside of the centering block 35. Further raising of the container causes the neck rim 36, first to be centered, then to be seated and sealed against the centering blocks. To facilitate this seal a thin washer 65 of rubber or other suitable resilient material is mounted in a groove 64 in the tapered wall 37. As the container neck is raised it engages the washer 65 and forces is against the tapered wall 37 above groove 64, thus forming the seal.

In this raised position the containers may then be filled through filler tubes 34 with liquid under pressure from lines 38 while air within the containers is withdrawn through the space between the container neck and the fill tube through the chambers 39 by vacuum lines 40.

The filling and exhausting mechanism is best shown in FIG. 5. In each double acting pump 26, piston 41 in upper cylinder 42 is connected by shaft 43 to piston 44 in lower cylinder 45. Movement of pump piston 41 is thereby controlled by movement of piston 44. Lower cylinder 45 has ports 46 and 47 at either end for the introduction and exhaust of pressurized operating fluid, which may be either liquid or gaseous, through lines 48 and 49. Introduction and exhaust of the operating fluid from a pressurized source, not shown, is controlled through an appropriate valving and control system of the type well known in the art. The source may be the same as that supplying operating fluid to shelf control cylinder 23. The controls of cylinders 45 and 23 may be interconnected for automatic operation of the cylinders in appropriate sequence.

The upper cylinder 42 of pump 26 has a port 50 communicating with the space above piston 41 and a port 51 communicating with the space below piston 41. Port 50 is connected through check valve 52 and lines 53 to the supply reservoir 56 of liquid with which the containers are to be filled. A pump 57 may be used, if desired, to charge line 53 with filler liquid. Port 50 is also connected through check valve 54 and lines 55 and 38 to one of the fill tubes 34 of centering block and fill tube assembly 28. Port 51 is connected to the exhaust chamber 39 of assembly 28 through lines 40 and 59 and check valve 58 and to a waste receptacle, not shown, through check valve 60 and lines 59 and 63.

The following describes the operation of the apparatus of the present invention in filling containers. An open shipping case 31 with empty containers 61 is positioned on elevator shelf 21, such as by hand or from conveyor 29. The shelf, case and empty containers are raised by piston shaft 22 through the introduction of pressurized operating fluid through inlet 32 to cylinder 23. The shelf is raised until the container neck openings contact, are centered by and seal against their respective centering blocks 35 as shown in FIG. 4 and in phantom in FIG. 1. At the same time preferably, or before or after if desired, pressurized operating fluid is introduced through line 49 and port 47 into the lower cylinder 45 of pump 26. Piston 44 is thus forced to the bottom of cylinder 45 to the position shown in FIG. 5. Pump piston 41 connected to piston 44 by shaft 43 is forced to the bottom of cylinder 42. The partial vacuum created above piston 41 draws supply liquid from the reservoir 56 through lines 53, check valve 52 and port 50 to fill the space above piston 41. The volume of this space determines the amount of liquid supplied to fill the container. Thus the pump may be sized to deliver nominally one gallon per stroke, for example. The length of the stroke may then be adjusted to provide exact desired volume in a manner well known.

At the same time the cylinder space above piston 41 is being filled, the contents of the cylinder space below piston 41 is being forced out through lines 59 and 61 and check valve 60 to a waste receptacle. Check valve 58 prevents flow into line 40.

After the container necks 36 have been seated to seal against centering blocks 35, upward stroke of the pump 26 is initiated by admission of pressurised working fluid to cylinder 45 through line 48 and port 46. As piston 41 is forced up by piston 44 and shaft 43 filler liquid is forced out of cylinder 42 through port 50 and, being blocked by check valve 52, through check valve 54, lines 55 and 38 and filler tube 34 into the container 61. The upward movement of piston 41 to force the emission of filler liquid simultaneously produces a partial vacuum below piston 41 in cylinder 42, which acts through lines 59, check valves 58 and lines 40 to suck the air from the container being filled and any foam or bubbles produced by the filling operation. This material is then exhausted through lines 59, check valve 60 and lines 61 to a waste receptacle by the next downward stroke of piston 41.

After the containers have been filled, elevator shelf 21 is lowered by operation of cylinder 23, case 31 removed, mechanically or by hand, to conveyor 30, for example. The apparatus is then ready to receive another case of empty containers and repeat its filling cycle.

It is to be recognized that the apparatus disclosed herein may be used to fill some containers in a carton or case with one liquid and other containers in the same carton with a different liquid simultaneously when the two different liquids are intended to be used or sold together. In fact, each container in the carton could be filled with a different liquid simultaneously. Such filling with different liquids is easily accomplished by merely changing the feed system to lines 53. For example, the lines 53 on the right side of FIG. 3 could be supplied from a reservoir containing one filler liquid and lines 53 on the left side of FIG. 4 supplied from a different reservoir containing a different filler liquid. Obviously the check valves 52 could each be connected to different separate reservoirs each containing a different filler liquid. It is equally obvious that only minor changes in the design of the apparatus are required for its use in filling different sizes and volumes of containers, even in the same case or carton, and, of course, different numbers of bottles per case.

Whereas this invention has been illustrated and described herein with respect to a particular embodiment, it is to be realized that various changes may be made without departing from essential contributions to the art made by the teachings hereof.

I claim:

1. An in-case container filling apparatus comprising:

(a) elevator shelf means adapted to receive an open shipping case containing a plurality of containers to be filled with liquid;

(b) filler tubes and centering block assembly means mounted above said elevator shelf comprising a plurality of filler tube means each surrounded by a centering block, exhaust chamber and seal means, and each so arranged and oriented as to be in register with a container opening when said shipping case is in place in said elevator shelf;

(c) pump means associated with each said filler tube and surrounding centering block comprising a cylinder and a piston movable within and separating said cylinder into two variable size chambers, each chamber having a port providing access therein;

(d) means communicating between each said filler tube and one of said chambers of its associated pump means and allowing liquid flow only from said chamber to said filler tube;

(e) means communicating between a source of filler liquid and each of said one of said chambers and allowing liquid flow only from said source to said chamber;

(f) means communicating between each said centering block exhaust chamber and the other chamber of its associated pump means and allowing fluid flow only from said exhaust chamber to said other chamber;

(g) means communicating between each of said other chambers of each of said pump means and a waste receiving means and allowing fluid flow only from said other chambers to said waste receiving means;

(h) means raising said elevator shell to position each of said empty containers for filling with its filler opening in sealed engagement with its associated centering block such that the interior of said container is in communication with the exhaust chamber associated therewith and said filler tube extends into said container, said means thereafter lowering said elevator shelf; and (i) means operative to move said pistons of said pump means to draw liquid from said liquid source into said one of said chambers and to expel the contents of the other of said chambers to said waste receiving means, and thereafter operative to move said piston to expel the filler liquid then in said one of said chambers through said filler tube into said container and to draw into said other chamber unwanted contents of said container.

2. The in-case container filling apparatus of claim 1, wherein said means communicating between said filler tube and ones of said chambers, said means communicating between said source of filler liquid and said one of said chambers, said means communicating between said centering block exhaust chamber and said other chamber and said means communicating between said other chamber and said waste receiving means all comprise check valves allowing passage of fluid in only one direction.

3. The in-case container filling apparatus of either claim 1 or claim 2, wherein said means to raise said elevator shelf and said means operative to move said pistons are fluid operated means.

4. The in-case container filling apparatus of claim 3, wherein said apparatus is mounted on wheels.

5. The in-case container filling apparatus of claim 4, wherein at least some of said one of said chambers are communicated to a different source of filler liquid than others of said one of said chambers.

6. The in-case container filling apparatus of claim 3, wherein said elevator shelf in its unraised position is adapted to receive in-case empty containers from conveyor means and to feed in-case filled containers to conveyor means.

7. The in-case container filling apparatus of claim 6, wherein said apparatus is mounted on wheels.

8. The in-case container filling apparatus of claim 3, wherein at least some of said one of said chambers are communicated to a different source of filler liquid than others of said one of said chambers.

9. The in-case container filling apparatus of either claim 1 or claim 2, wherein said apparatus is mounted on wheels.

10. The in-case container filling apparatus of claim 9, wherein at least some of said one of said chambers are communicated to a different source of filler liquid than others of said one of said chambers.

11. The in-case container filling apparatus of either claim 1 or claim 2, wherein said elevator shelf in its unraised position is adapted to receive in-case empty containers from conveyor means and to feed in-case filled containers to conveyor means.

12. The in-case container filling apparatus of claim 11, wherein said apparatus is mounted on wheels.

13. The in-case container filling apparatus of claim 11, wherein at least some of said one of said chambers are communicated to a different source of filler liquid than others of said one of said chambers.

14. The in-case container filling apparatus of either claim 1 or claim 2, wherein at least some of said one of said chambers are communicated to a different source of filler liquid than others of said one of said chambers.

15. The in-case container filling apparatus of claim 14, wherein said apparatus is mounted on wheels.

* * * * *